US009728145B2

(12) United States Patent
Yang et al.

(10) Patent No.: US 9,728,145 B2
(45) Date of Patent: Aug. 8, 2017

(54) METHOD OF ENHANCING MOVING GRAPHICAL ELEMENTS

(75) Inventors: Sen Yang, Palatine, IL (US); Brian M. Collins, South San Francisco, CA (US); Daniel C. Wong, San Jose, CA (US); Zhiming Zhuang, Kildeer, IL (US)

(73) Assignee: GOOGLE TECHNOLOGY HOLDINGS LLC, Mountain View, CA (US)

( * ) Notice: Subject to any disclaimer, the term of this patent is extended or adjusted under 35 U.S.C. 154(b) by 834 days.

(21) Appl. No.: 13/360,612

(22) Filed: Jan. 27, 2012

(65) Prior Publication Data

US 2013/0194313 A1 Aug. 1, 2013

(51) Int. Cl.
*G09G 5/00* (2006.01)
*G09G 5/10* (2006.01)
(Continued)

(52) U.S. Cl.
CPC ... *G09G 3/3611* (2013.01); *G09G 2300/0447* (2013.01); *G09G 2320/0257* (2013.01);
(Continued)

(58) Field of Classification Search
CPC .. G06F 3/03547; G06F 3/0485; G06F 3/0338; G06F 3/0488; G06F 3/04812;
(Continued)

(56) References Cited

U.S. PATENT DOCUMENTS 6,628,295 B2 * 9/2003 Wilensky ..... G06T 11/00 345/594
7,956,834 B2 6/2011 Kang
(Continued)

FOREIGN PATENT DOCUMENTS

EP 1589763 A2 10/2005
EP 2107519 A1 10/2009
(Continued)

OTHER PUBLICATIONS

Patent Cooperation Treaty, "PCT Search Report and Written Opinion of the International Searching Authority" for International Application No. PCT/US2013/020608, Mar. 19, 2013, 17 pages.
(Continued)

*Primary Examiner* — Ryan R Yang
(74) *Attorney, Agent, or Firm* — Morris & Kamlay LLP

(57) ABSTRACT

A method performed by a processor of a electronic device, including rendering (402), on an electronic display, a line segment having a first direction and moving in a second direction. The method also includes a step of determining (404) whether the direction of the line segment (the first direction) is in the same direction that the line segment is moving (the second direction). If the processor determines that the line segment is not moving in the same direction of the direction of the line segment (the first direction), then the processor performs (408) a first action, such as adjusting the color intensity of the line segment. If the processor determines that the line segment is moving in the same direction of the direction of the line segment (e.g., the two directions are substantially parallel to each other), then the processor performs (406) a second action.

17 Claims, 7 Drawing Sheets

(51) Int. Cl.

| | |
|---|---|
| ***G06T 11/00*** | (2006.01) |
| ***G06F 3/038*** | (2013.01) |
| ***G09G 3/34*** | (2006.01) |
| ***G09G 3/36*** | (2006.01) |

(52) U.S. Cl.
CPC ..... *G09G 2320/0261* (2013.01); *G09G 2320/106* (2013.01); *G09G 2340/16* (2013.01)

(58) Field of Classification Search
CPC ..... G06F 3/04842; G06F 3/0482; G06F 3/04845; G06F 3/0481; G06F 3/018
USPC ..... 345/676, 613
See application file for complete search history.

(56) References Cited

U.S. PATENT DOCUMENTS

| | | | | |
|---|---|---|---|---|
| 8,004,539 | B2 | 8/2011 | McDaniel et al. | |
| 2003/0020729 | A1* | 1/2003 | Toji et al. | 345/613 |
| 2003/0160805 | A1* | 8/2003 | Toji et al. | 345/694 |
| 2005/0232356 | A1 | 10/2005 | Gomi et al. | |
| 2006/0077490 | A1 | 4/2006 | Sheraizin et al. | |
| 2006/0082597 | A1* | 4/2006 | McDaniel | G06T 11/60 345/648 |
| 2007/0057895 | A1 | 3/2007 | Kong et al. | |
| 2007/0063947 | A1 | 3/2007 | Kang et al. | |
| 2008/0180453 | A1 | 7/2008 | Fergason et al. | |
| 2008/0238839 | A1* | 10/2008 | Kim et al. | 345/83 |
| 2008/0303824 | A1 | 12/2008 | Suzuki | |
| 2009/0070363 | A1* | 3/2009 | Bull | G11B 27/34 |
| 2009/0245639 | A1 | 10/2009 | Erdler et al. | |
| 2010/0214299 | A1* | 8/2010 | Robertson | G06T 13/80 345/440 |
| 2010/0315448 | A1* | 12/2010 | Kong et al. | 345/690 |
| 2013/0106917 | A1* | 5/2013 | Altin | 345/677 |

FOREIGN PATENT DOCUMENTS

| | | | |
|---|---|---|---|
| JP | 2010-66414 | A | 3/2010 |
| JP | 2010066414 | A | 3/2010 |
| WO | WO-2011047338 | A1 | 4/2011 |
| WO | WO-2011130919 | A1 | 10/2011 |

OTHER PUBLICATIONS

Wikipedia, "HDTV Blur", http://en.wikipedia.org/wiki/HDTV_blur, accessed Jan. 25, 2011, 5 pages.
PC Magazine Encyclpedia, "Submarining", http://www.pcmag.com/encyclopedia_term/0,2542,t=submarining&l=52183,00.asp, accessed Jan. 25, 2011, 2 pages.
metaglossary.com, "Passive Matrix LCD", http://www.metaglossary.com/meanings/1621762/, accessed Jan. 25, 2011, 2 pages.
robroad.com, "Toshiba's Flagship High-End LCD Dynamic Tailing Embarrassment", http://www.robroad.com/light-industry/global/200806/25766.html, Jun. 22, 2007, 1 page.
Hitachi, Ltd., "Long History of Hitachi IPS Technology", http://www.hitachi.com.tw/download/dp/IPS_tech_introduction.pdf, 2008, 9 pages.
TFT Central, "Advanced Technology", http://www.tftcentral.co.uk/advancedcontent.htm, downloaded Nov. 28, 2012, 30 pages.
Linkai Bu and Shing-Chia Chen, "A Novel Dynamic Over-Drive Scheme for LCD with Dynamic Driving Gamma Curves", 2010 Int'l Symp. on VLSI Design Automation and Test (VLSI-DAT), Apr. 26-29, 2010, pp. 45-48.
Communication issued in EP Application No. 13700956.9 on Oct. 2, 2015.
Office Action dated Jul. 12, 2016 as received in CN Application No. 201380017217.7.
Office Action dated Sep. 20, 2016 as received in EP Application No. 13700956.9.
Office Action dated Mar. 8, 2017 as received in CN Application No. 201380017217.7.

* cited by examiner

METHOD OF ENHANCING MOVING GRAPHICAL ELEMENTS

FIELD

This disclosure relates in general to human interaction with an electronic device, and more specifically to enhancing fast moving graphical user interface (GUI) elements.

BACKGROUND

Portable electronic devices such as smart phones, personal digital assistants (PDAs), and tablets have become popular and ubiquitous. More and more features have been added to these devices, and they are often equipped with powerful processors, significant memory, and open operating systems, which allow many different applications to be added. Popular applications provide functions such as calling, emailing, texting, image acquisition, image display, music and video playback, location determination (e.g., GPS), internet browsing functions, and gaming, among others. Further, such devices often include various user input components for communicating instructions to control operation of the electronic device. For example, many electronic devices are equipped not only with various buttons and/or keypads, but also with touch detecting surfaces (such as touch screens or touch pads) by which a user, simply by touching a particular area of the electronic device and/or by moving a finger along the surface of the electronic device, is able to communicate instructions to control the electronic device.

A number of such electronic devices (such as smart phones) have display screens with vertical alignment liquid crystal display (VA LCD) technology. Such display screens are preferred over other types of LCD screens because VA LCD screens have an adequate number of viewing angles and are less expensive than other technologies, such as in-plane switching LCD (IPS LCD) screens. IPS LCD screens, however, have a faster pixel transition time than VA LCD screens for transitions between colors that differ slightly in their shade.

The slower transition times of VA LCD screens can cause distortions to the graphical user interface. For example, a common blemish associated with VA LCD screens is the vanishing of dark gray lines when they are moving on a very dark gray (or black) background. This blemish is commonly known as "submarining". This phenomenon can be observed when scrolling through the settings menu of some versions of the ANDROID operating system. Another known flaw to occur on VA LCD screens is often called "tailing", which is an effect that occurs when a dark colored graphical object moves on a lighter colored background causing a tail of the dark color to drag behind the object as it is moved across the display.

Considering these issues, it would be desirable to provide an electronic device, having a VA LCD screen (or any other type of display with various response speeds at different gray levels), with one or more features to address one or more of these (and possibly other) concerns.

DETAILED DESCRIPTION

An electronic device with a display screen (and in at least some embodiments a mobile device with a vertical alignment liquid crystal display (VA LCD screen)) has a processor (or controller) that can perform one or more methods for reducing "tailing" and/or the opposite effect commonly known as "submarining" (e.g., the vanishing of dark gray lines when the lines are moving on a very dark gray (or black) background on a graphical user interface (GUI)). Additionally, the electronic device can perform a method that includes, first, the processor rendering a moving graphical object having a line segment on the display screen, and then second, the processor determining whether the direction of the line segment (its orientation) is similar (e.g., parallel, or substantially parallel) to the direction that the line segment is moving. In the case where the two directions are not similar, the processor performs a first action, such as adjusting the color or brightness of the line segment. In the other case, where the two directions are similar, the processor performs a second action, such as keeping the characteristics of the line segment substantially similar as they were prior to the line segment moving (besides location characteristics of the line segment).

Figure 1:
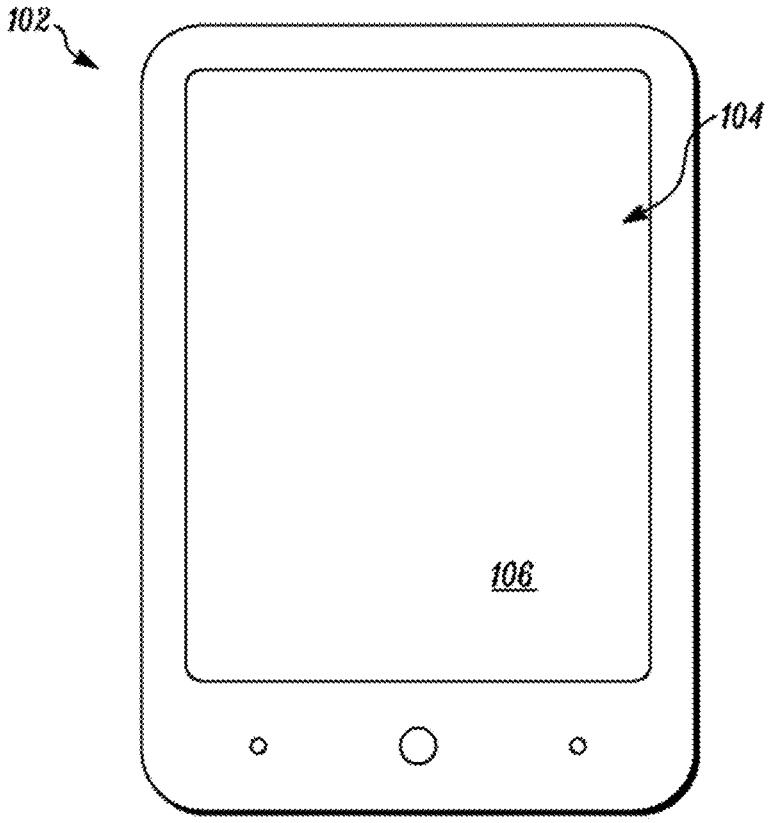
FIG. 1 is a front view of an example electronic device.

Referring now to FIG. 1, an example mobile electronic (or simply "mobile") device 102 is illustrated which can take the form of a mobile phone (as more fully described with respect to FIG. 2) and can include functions such as calling, emailing, texting, image acquisition, internet browsing functions, and gaming functions, as well as others. In other embodiments, the electronic device can be one of a variety of other devices such as a personal computer, personal digital assistant, remote controller, electronic book reader, television screen, laptop computer, or tablet computing device. The electronic device 102 includes a movement sensing assembly, which in FIG. 1 takes the form of a touch detecting surface 104 associated with a display screen 106 to form a touch screen. The touch detecting surface 104 can be any of a variety of known touch detecting technologies such as a resistive technology, a capacitive technology, or an optical technology. As illustrated, the touch detecting surface 104 includes a light permeable panel or other technology that overlaps the display screen 106, which can be any type of display screen with various response speeds at different gray levels. In some embodiments, the display screen 106 is a VA LCD screen. In addition to the display screen 106, the electronic device 102 can optionally include a keypad and other known user input devices.

The electronic device 102 is operable to detect and identify various gestures by a user (where each gesture is a specified pattern of movement of an external object, such as a hand or one or more fingers, relative to the touch detecting surface 104) in one of a variety of known ways. Use of the touch screen formed by the touch detecting surface 104 and the display screen 106 is advantageous because the display screen displays changeable graphics directly underlying the touch detecting surface upon which (or in relation to) controlling hand gestures are applied. Such gestures, for example, can cause a single line segment or a graphical object including a line segment on one of its borders to move in a linear direction 506 or angular direction 606 as shown, for example, in FIGS. 5 and 6, respectively.

Figure 2:
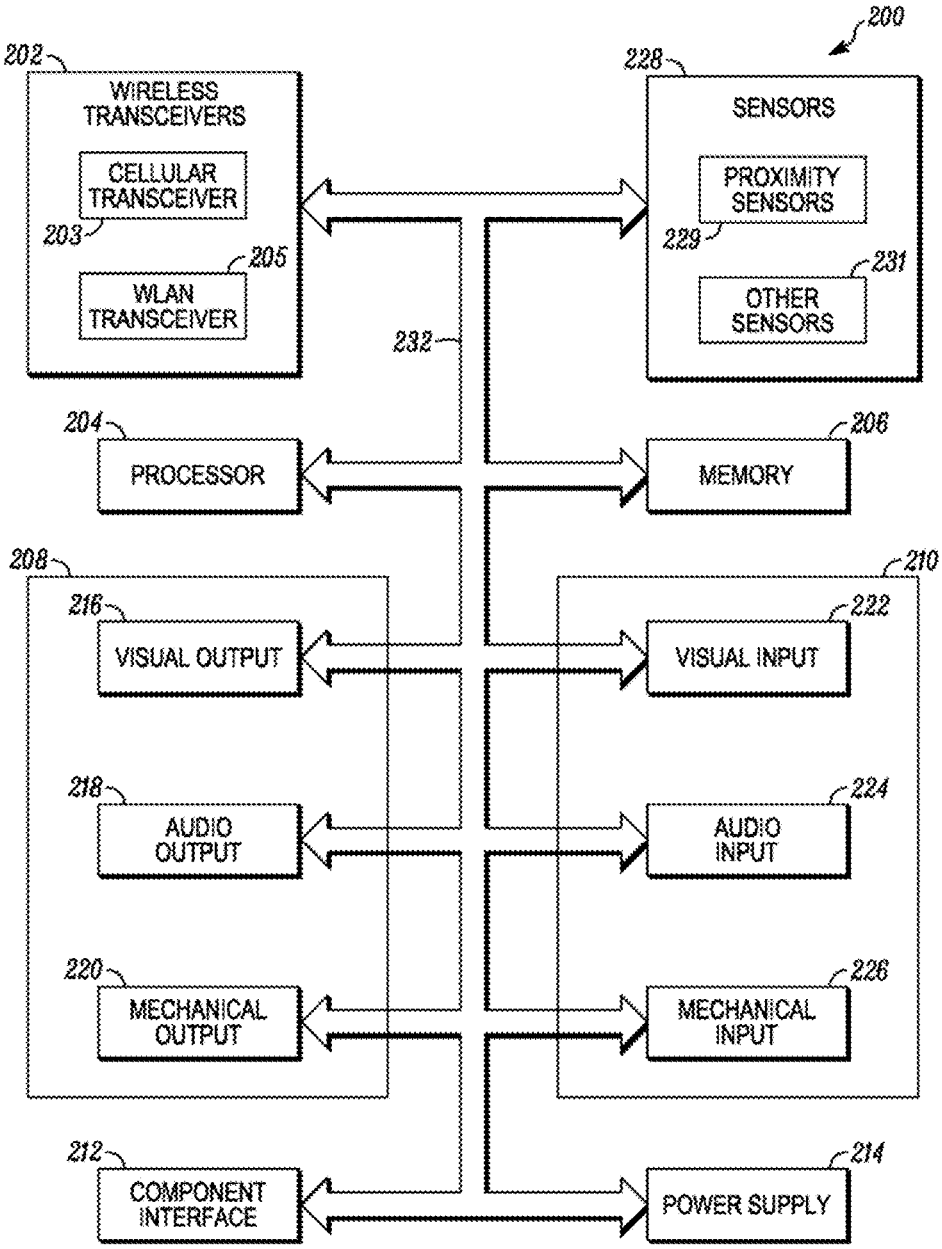
FIG. 2 is a block diagram of example components of the example electronic device of FIG. 1.

Referring to FIG. 2, a block diagram 200 illustrates example components of a mobile smart phone implementation of the electronic device 102. These components can include wireless transceivers 202, a processor 204 (e.g., a microprocessor, microcomputer, application-specific integrated circuit, or the like), memory 206, one or more output components 208, one or more input components 210, and one or more sensors 228. The electronic device 102 can also include a component interface 212 to provide a direct connection to auxiliary components or accessories for additional or enhanced functionality, and a power supply 214, such as a battery, for providing power to the other internal components. All of the internal components can be coupled to one another, and in communication with one another, by way of one or more internal communication links 232, such as an internal bus.

The memory 206 (which in at least some embodiments, the processor 204 and the memory 206 are tightly coupled, such as being on the same silicon chip) can encompass one or more memory devices of any of a variety of forms (e.g., read-only memory, random access memory, static random access memory, dynamic random access memory, etc.), and can be used by the processor 204 to store and retrieve data. The data that is stored by the memory 206 can include operating systems, applications, and informational data. Each operating system includes executable code that controls basic functions of the electronic device, such as interaction among the various internal components, communication with external devices via the wireless transceivers 202 and/or the component interface 212, and storage and retrieval of applications and data to and from the memory 206. Although many such programs govern standard or required functionality of the electronic device 102, in many cases the programs include applications governing optional or specialized functionality, which can be provided in some cases by third party vendors unrelated to the electronic device manufacturer.

Finally, with respect to informational data, this is non-executable code or information that can be referenced and/or manipulated by an operating system or program for performing functions of the electronic device 102. Such informational data can include, for example, data that is preprogrammed upon the electronic device 102 during manufacture, or any of a variety of types of information that is uploaded to, downloaded from, or otherwise accessed at servers or other devices with which the electronic device 102 is in communication during its ongoing operation.

Figure 3:
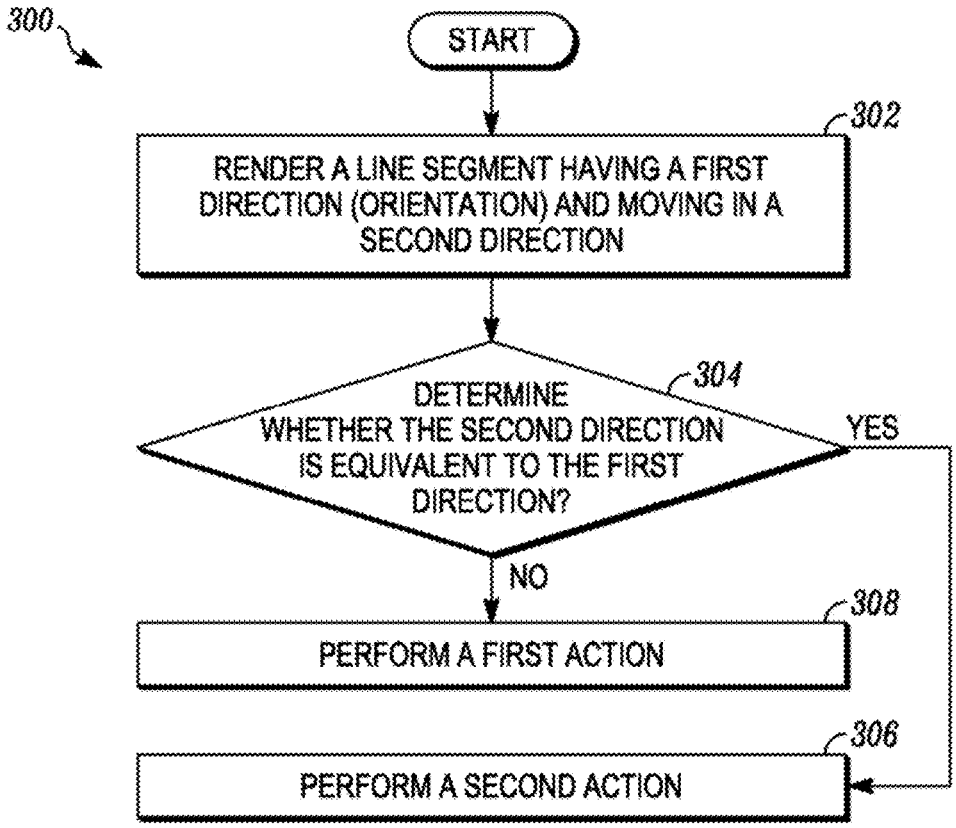
FIG. 3 illustrates an example method for the electronic device of FIG. 1.
Figure 4:
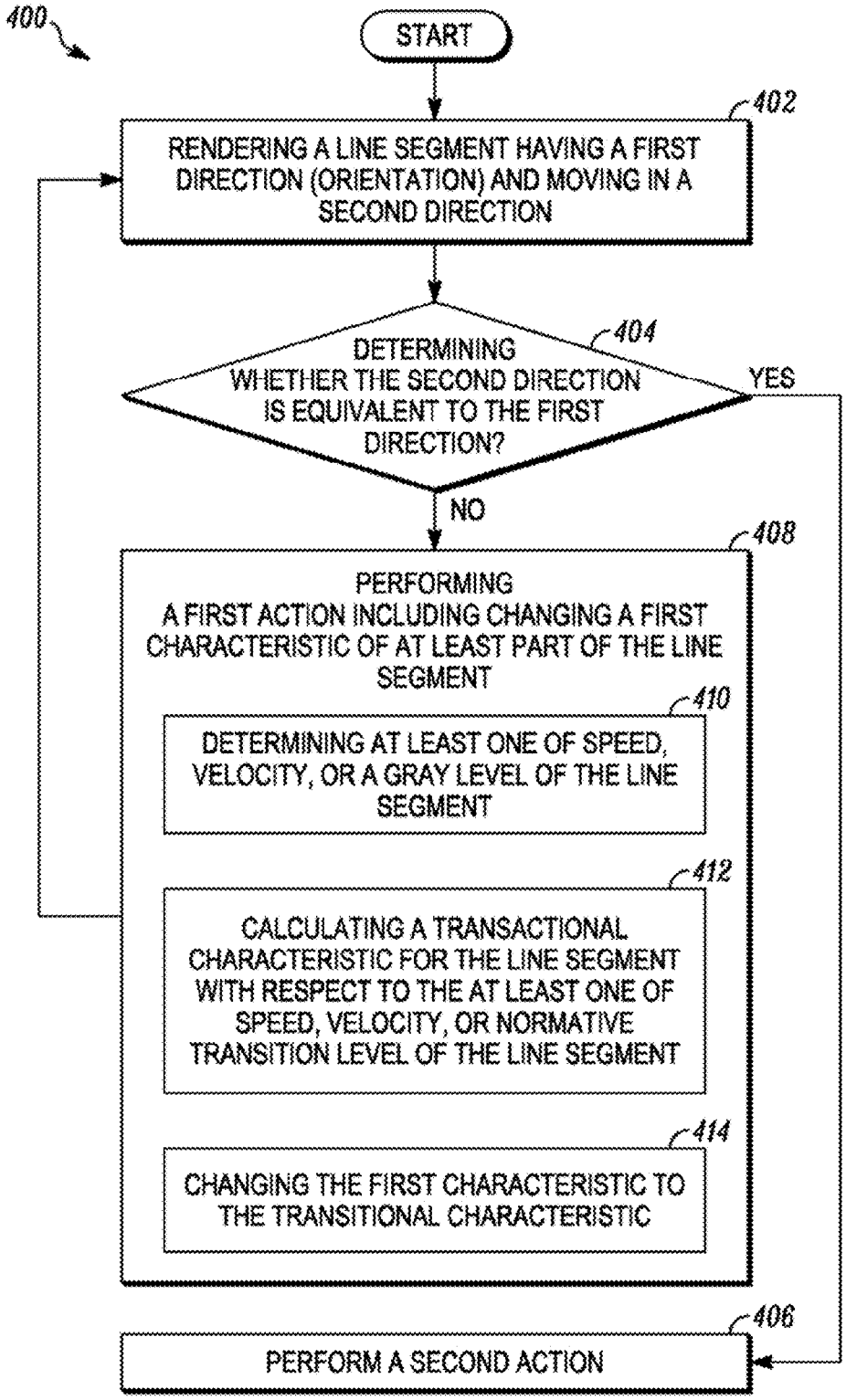
FIG. 4 illustrates another example method for the electronic device of FIG. 1.

Additionally, the electronic device 102 can be programmed such that the processor 204 and memory 206 interact with the other components of the electronic device to perform a variety of functions, including the methods illustrated in FIGS. 3-4. Although not specifically shown in FIG. 2, the processor can include various modules for performing the methods illustrated in FIGS. 3-4. Further, the processor can include various modules for initiating different activities known in the field of electronic devices and disclosed herein.

The wireless transceivers 202 in the present embodiment include both a cellular transceiver 203 and a wireless local area network (WLAN) transceiver 205. Each of the wireless transceivers 202 utilizes a wireless technology for communication, such as cellular-based communication technologies including analog communications (using AMPS), digital communications (using CDMA, TDMA, GSM, iDEN, GPRS, EDGE, etc.), and next generation communications (using UMTS, WCDMA, LTE, IEEE 802.16, etc.) or variants thereof, or peer-to-peer or ad hoc communication technologies such as HomeRF, Bluetooth and IEEE 802.11 (a, b, g or n), or other wireless communication technologies. Although the wireless transceivers 202 include in this embodiment the transceivers 203 and 205, in other embodiments, only one of the transceivers is present and/or one or more other transceivers are present.

Exemplary operation of the wireless transceivers 202 in conjunction with others of the internal components of the electronic device 102 can take a variety of forms and can include, for example, operation in which, upon reception of wireless signals, the internal components detect communication signals and one of the wireless transceivers 202 demodulates the communication signals to recover incoming information, such as voice and/or data, transmitted by the wireless signals. After receiving the incoming information from the wireless transceiver 202, the processor 204 formats the incoming information for the one or more output components 208. Likewise, for transmission of wireless signals, the processor 204 formats outgoing information, which may or may not be activated by the input components 210, and conveys the outgoing information to one or more of the wireless transceivers 202 for modulation as communication signals. The wireless transceiver(s) 202 convey the modulated signals to a remote device, such as a cell tower or an access point (not shown).

The output components 208 can include a variety of visual, audio, and/or mechanical outputs. For example, the output components 208 can include one or more visual output components 216 such as a VA LCD display screen 106 or any other type of display with various response speeds at different gray levels. One or more audio output components 218 can include a speaker, alarm, and/or buzzer, and one or more mechanical output components 220 can include a vibrating mechanism for example. Similarly, the input components 210 can include one or more visual input components 222 such as an optical sensor of a camera, one or more audio input components 224 such as a microphone, and one or more mechanical input components 226 such as the touch detecting surface 104 of FIG. 1.

The sensors 228 can include both proximity sensors 229 and other sensors 231, such as an accelerometer, a gyroscope, or any other sensor that can provide pertinent information, such as to identify a current location or orientation of the device 102. Actions that can actuate one or more input components 210 can include for example, powering on, opening, unlocking, moving, and/or operating the device 102. For example, upon power on, a 'home screen' with a predetermined set of application icons can be displayed on the display screen 106.

As understood by those in the art, processor 204 executes computer program code to implement the methods described herein. Embodiments include computer program code containing instructions embodied in tangible media, such as floppy diskettes, CD-ROMs, hard drives, or any other computer-readable storage medium, where, when the computer program code is loaded into and executed by a processor, the processor becomes an apparatus for practicing the methods disclosed herein. Embodiments include computer program code, for example, whether stored in a storage medium, loaded into and/or executed by a computer, or transmitted over some transmission medium, such as over electrical wiring or cabling, through fiber optics, or via electromagnetic radiation, where, when the computer program code is loaded into and executed by a computer, the computer becomes an apparatus for practicing the methods disclosed herein. When implemented on a general-purpose microprocessor, the computer program code segments configure the microprocessor to create specific logic circuits.

Figure 7:
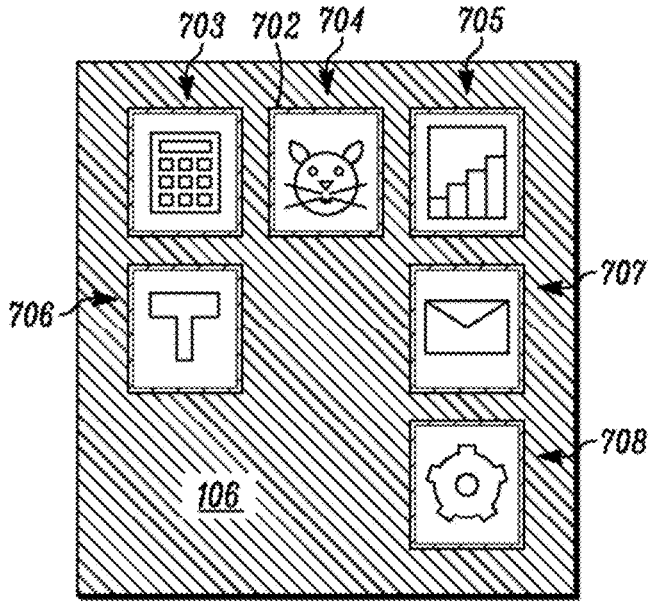
FIGS. 7-8 are additional example front views of the display screen of the example electronic device of FIG. 1.
Figure 8:
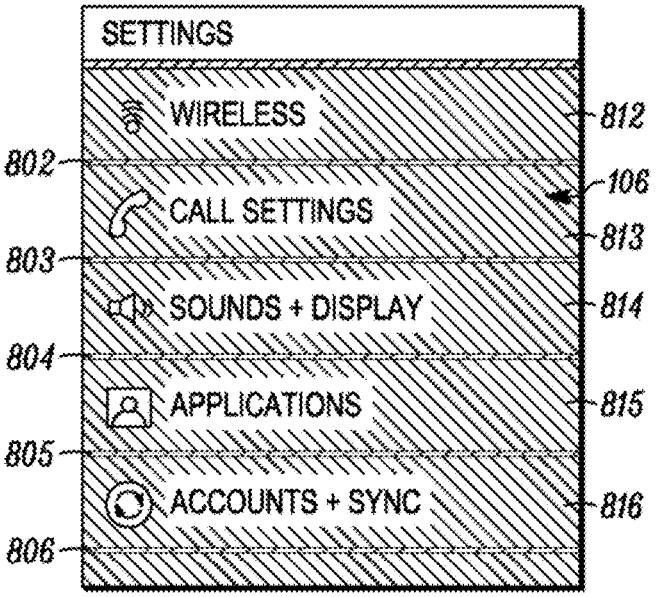

FIG. 3 illustrates a flow chart 300 representative of a method that the electronic device 102 of FIG. 1 can perform, such as at a time when a set of one or more graphical icons (where each icon has a border made up of line segments) are displayed on the display screen 106 (e.g., depicted in FIG. 7) or when a set of graphical objects that are line segments separate other graphical icons in a list displayed on the display screen 106 (e.g., depicted in FIG. 8). The graphical icons may be selectable icons (e.g., for launching software applications or controlling device settings) or non-selectable icons for display of information such as status information (e.g., no disc in a DVD player, battery level, social network status, etc.).

Figure 5:
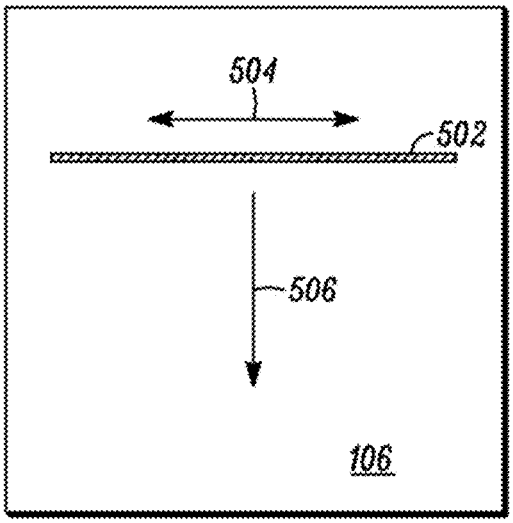
FIG. 5 is an example front view of a display screen of the example electronic device of FIG. 1 illustrating an orientation (or direction) of a graphical object that is line segment and a direction of movement of the line segment, where the direction of the movement is linear.
Figure 6:
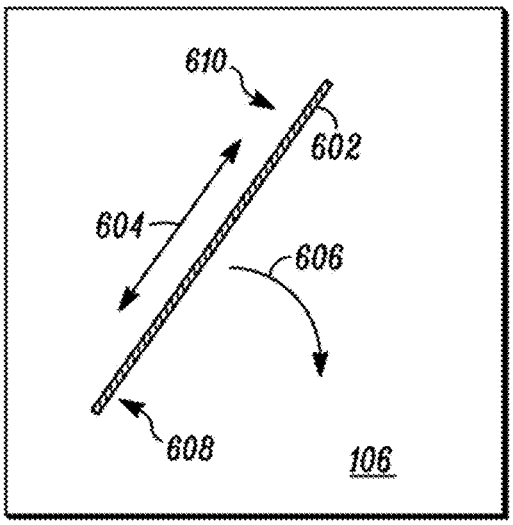
FIG. 6 is an additional example front view of the display screen of the example electronic device of FIG. 1 illustrating an orientation (or direction) of another graphical object that is a line segment and a direction of movement of the line segment, where the direction of the movement is angular.

The method begins at a step 302, where the processor 204 renders or causes the display of a line segment having a first direction (or orientation) and moving in a second direction on the display screen 106 (in at least some embodiments a VA LCD screen). The line segment can be, for example a line segment 502 as shown in FIG. 5 or a line segment 602 as shown in FIG. 6. The first direction can be parallel to the axis of the line, for example as represented by an arrow 504 of FIG. 5 or an arrow 604 as shown in FIG. 6. In addition, the second direction can be linear or angular as represented by arrows 506 and 606 as shown in FIGS. 5 and 6, respectively.

In addition to being a stand-alone graphical object (as shown in FIGS. 5-6), the line segment may be part of a larger graphical object such as a layered graphical object or other predefined artwork. With respect to FIGS. 7 and 8, in at least some embodiments, the set of predefined graphical icons (e.g., icons 703, 704, 705, 706, 707, 708 or icons 712, 713, 714, 715, 716) each have a border made up of line segments. For example in FIG. 7, a line segment 702 of the icon 704 is pointed out. In actuality, in FIG. 7, each of the icons 703, 704, 705, 706, 707, 708 has a border with four line segments. Additionally, several of the icons have line segments within the border. Meanwhile in FIG. 8, each of the setting icons 812, 813, 814, 815, 816 has two respective line segments 802, 803, 804, 805, 806 graphically separating each setting icon. In this case, each of the line segment icons between two of the setting icons are shared by the two setting icons. For example, the setting icons 812 and 813 share the line segment 802.

As the line segment is moving, at a step 304, the processor 204 determines whether the second direction is similar (e.g., parallel or substantially parallel) to the first direction, where if the processor 204 determines that the second direction is not similar to the first direction, then the processor 204 performs a first action (e.g., a step 308). Alternatively, if the processor 204 determines that the second direction is similar to the first direction, then the processor 204 performs a second action (e.g., a step 306) different from the first action. Note that for graphical objects that include multiple line segments, movement of the graphical object in a particular second direction may result in some line segments that are oriented parallel to the second direction and other line segments that are oriented non-parallel relative to the second direction.

The processor may perform the first action under several circumstances. For example, referring to FIGS. 5 and 6, when the line segment 502 is moving in a linear direction 506 perpendicular (or substantially perpendicular) with respect to the orientation of the line segment 502 as indicated by the arrow 504, as shown in FIG. 5, then the processor 204 performs the first action. In at least some embodiments, when the line segment is moving linearly and is not moving parallel (or substantially parallel) with respect to the orientation of the line segment, then the processor 204 performs the first action corresponding to the step 308. Additionally, when the line segment 602 is moving in an angular direction 606 with respect to the orientation of the line segment 602 as indicated by the arrow 604, as shown in FIG. 6, then the processor 204 also performs the first action.

It should be noted that the term "angular" as used herein can encompass a variety of movements including linear and/or rotational movements. With respect to the angular direction 606 shown in FIG. 6, the angular direction 606 is rotational in that it is a product of the line segment 602 rotating about a point 608 (e.g., an end point) of the line segment 602. Because of the nature of this angular motion, a distal end 610 of the segment 602 will move at a greater speed than an other part of the segment 602 proximate to the point (or axis) 608 of rotation. This can be considered in making a number of the calculations as will be mentioned below.

Referring now to FIG. 4, a further flow chart 400 is provided representative of an additional method. As shown, the method of FIG. 4 includes steps 402, 404, and 406 that are respectively the same as the steps 302, 304, and 306 of FIG. 3. However, FIG. 4 illustrates additional sub-steps that together make up a first action at a step 408, which is an alternative to the step 308 of FIG. 3. More particularly, the first action at the step 408 includes the processor 204 causing changing of a first characteristic of at least part of a line segment of interest (e.g., the line segments 502 or 602). Sub-steps 410, 412, 414 of the step 408 illustrate a sub-method for changing the first characteristic of at least part of the line segment.

At step 410, the processor 204 determines at least one of a speed, a velocity, and/or a gray level of the line segment from a part of data representing the predefined graphic element moving on the display 106, depending on the embodiment. Then at the step 412, the processor 204 calculates a transitional characteristic for the line segment with respect to the speed, the velocity, and/or the gray level of the line segment (again, depending on the embodiment). Finally, at the step 414, the processor 204 changes the first characteristic of at least part of the line segment to the transitional characteristic and in turn renders the line segment to the display screen 106 (with the transitional characteristic). In at least some embodiments, the changing of the first characteristic further includes the processor 204 determining the thickness of the line segment, and then in turn calculating the transitional characteristic for the line segment with respect to the thickness of the line segment. For example, if the thickness of the line segment has a width of two or three pixels as opposed to a width of one pixel, a first array of pixels along the length of the line segment will transition from black to gray and the second (or the second and third) array of pixels along the length of the line segment will transition from gray to gray.

In at least some embodiments, where the second direction (the line segment's direction of movement such as the direction 606) is angular relative to the first direction (orientation of the line segment such as indicated by the arrow 604), such that the processor 204 is triggered to perform the first action, the first action can include a step of changing the first characteristic of an outside line sub-segment furthest away from a point of rotation of the second direction (in other words changing the first characteristic of a distal portion of the line segment).

Figure 9:
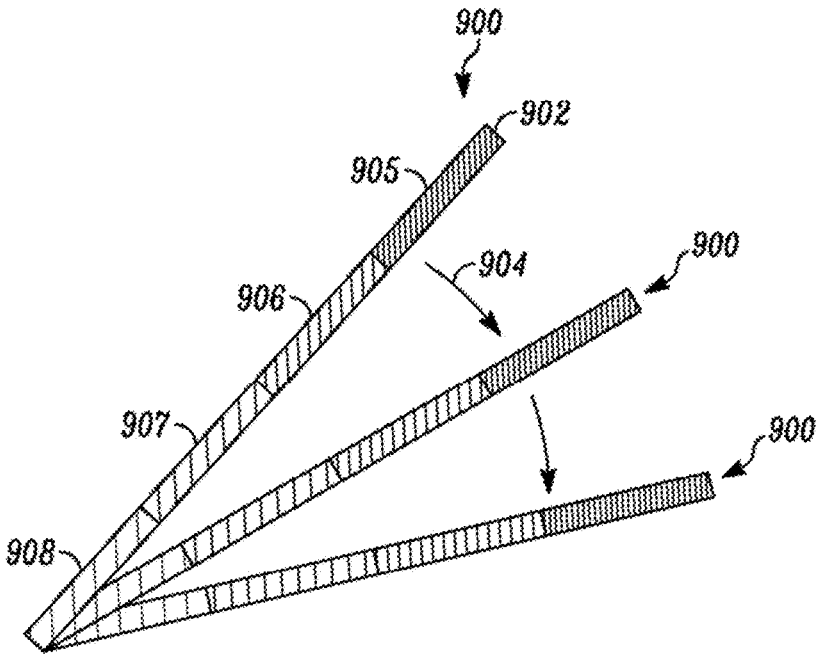
FIG. 9 illustrates an implementation of an example additional method from FIG. 4 where a direction of movement of a graphical object that is a line segment is angular.

With reference to FIG. 9, in some more complex embodiments, when the second direction is angular, e.g., as represented by an arrow 904 of FIG. 9, the processor 204 can vary the transitional characteristic of more than one of the sub-segments (e.g., sub-segments 905, 906, 907, 908) so that the line sub-segments can be more color intense, lighter, brighter, and/or the like with respect to their proximity to the distal end 902 of the line segment 900, or vice versa. This functionality is advantageous considering the speed of the line segment is greater towards the distal end of the line segment when the line segment is moving in an angular direction. In other words, the functionality seeks to mitigate motion blur where it is more likely to be noticed and also not make adjustments (or make less drastic adjustments) where motion blur is less likely to be noticed.

Finally, with respect to the first characteristic of the line segment, the first characteristic can be color intensity (or another characteristic with respect to color, such as tint, shade, saturation, lightness, and/or brightness, depending on the embodiment). For example, the first characteristic can be one color intensity, and the transitional characteristic can be another color intensity. In at least some embodiments, the first characteristic of a line segment is a dark gray and the transitional characteristic is a light gray that varies in lightness depending on the speed that the segment is moving. For example, the faster the line segment is moving, the greater the lightness of the transitional characteristic. Such functionality prevents the line segment from disappearing when it moves in a direction not parallel to its orientation on a dark background (e.g., a black background).

Alternatively, for example, the faster the line segment is moving, the greater the darkness of the transitional characteristic. Such functionality prevents "tailing" when a line segment of a graphical asset moves in a direction not parallel to its orientation on a light background (e.g., a white or light gray background). Other functions can also reduce "submarining" of a line segment and can replace or be in addition to one of the first actions specified above (e.g., the first action at the step 408). For example, the first action can include increasing voltage applied to a grid of the display screen 106 (sometimes called "overdrive"), and then rendering the line segment to the display screen 106 after the increasing of the voltage.

In some other embodiments where the line segment is at least a part of a border of the graphical asset, the first action can be brightening or lightening the line segment and one or more other graphical elements that make up the border. For example, performing the first action could enable a brighter than usual border around the graphical asset. In another embodiment, the first action can include adding a brighter border around the graphical asset without altering brightness of an original line segment of the asset.

As noted previously there are several useful applications in the subject matter of this disclosure. For example, generally taught herein are achievable solutions that VA LCD screens can employ to reduce "tailing" or "submarining". These solutions can be combined with known techniques such as overdrive or the use of a bright border surrounding a graphical object when such object is in motion (e.g., a "halo") to provide the aforementioned benefits; however, the solutions described herein do not require the use of the known techniques. Not depending on the known techniques, especially overdrive, is a very beneficial considering that power resources are limited on some electronic devices such as mobile electronic devices.

In considering the above, it is specifically intended that the present invention not be limited to the embodiments and illustrations contained herein, but includes modified forms of those embodiments, including portions of the embodiments and combinations of elements of different embodiments as come within the scope of the following claims.

We claim:

1. A method performed by a processor of an electronic device, comprising:

rendering, on a display, a line segment having a first direction and moving in a second direction; and wherein if the processor determines that the line segment moving in the second direction is rotating relative to the first direction around a point of rotation wherein a line sub-segment of the line segment distal from the point of rotation moves at a greater speed than a second line sub-segment of the line segment proximate to the point of rotation, then the processor performs a first action, wherein the first action includes changing a first characteristic of the line sub-segment distal from the point of rotation, wherein the changing the first characteristic of the line-sub segment distal from the point of rotation comprises:

determining at least one of: a speed, a velocity, a color intensity, a tint, a shade, a saturation, a lightness, a brightness, or a gray level of the line sub-segment from a part of data representing the line sub-segment moving on the display;

calculating a transitional characteristic for the line sub-segment with respect to the at least one of: the speed, the velocity, the color intensity, the tint, the shade, the saturation, the lightness, the brightness, or the gray level of the line sub-segment; and changing the first characteristic of the line sub-segment to the transitional characteristic, and wherein if the processor determines that the line segment moving in the second direction is moving in a direction similar to the first direction, then the processor performs a second action.

2. The method of claim 1, further comprising:

if the processor determines that the line segment moving in the second direction is also moving in a perpendicular direction relative to the first direction, the first action comprises:

changing a second characteristic of at least part of the line segment; and rendering the line segment to the display after the changing the second characteristic.

3. The method of claim 2, wherein the changing the second characteristic comprises:

determining at least one of a speed, a velocity, or a gray level of the line segment from a part of data representing the line segment moving on the display;

calculating a transitional characteristic for the line segment based at least indirectly upon at least one of: the speed, the velocity, or the gray level of the line segment; and changing the second characteristic of at least part of the line segment to the transitional characteristic.

4. The method of claim 3 wherein the changing the second characteristic further comprises:

determining a thickness of the line segment, prior to the calculating the transitional characteristic; and wherein the calculating the transitional characteristic additionally comprises:

calculating the transitional characteristic for the line segment with respect to the thickness of the line segment.

5. The method of claim 3, wherein the second characteristic is color intensity.

6. The method of claim 3, wherein the second characteristic includes at least one of: a tint, a shade, a saturation, a lightness, or a brightness.

7. The method of claim 1, wherein the first action further comprises:

increasing a voltage applied to the display; and rendering the line segment to the display after the increasing the voltage applied to the display.

8. The method of claim 1, wherein if the processor determines that the line segment moving in the second direction is rotating relative to the first direction around the point of rotation, the method further comprises:

rendering the line segment to the display after the changing the first characteristic.

9. The method of claim 8 wherein the changing the first characteristic further comprises:

determining a thickness of the line segment, prior to the calculating the transitional characteristic; and wherein the calculating the transitional characteristic additionally comprises:

calculating the transitional characteristic for the line segment with respect to the thickness of the line segment.

10. The method of claim 1, wherein the first action comprises rendering a bright border around a rendered asset that contains the line segment.

11. The method of claim 1, wherein the second action includes at least one of:

keeping a first characteristic same as it was prior to the line segment moving; or keeping all characteristics same as they were prior to the line segment moving, with an exception of location characteristics of the line segment.

12. A method performed by a processor of an electronic device, comprising:

rendering, on a display, a line segment having an orientation and moving in a direction; and wherein if the line segment moving in the direction is rotating relative to the orientation direction around a point of rotation wherein a line sub-segment of the line segment distal from the point of rotation moves at a greater speed than a second line sub-segment of the line segment proximate to the point of rotation, then the processor performs a first action, wherein the first action includes changing a first characteristic of the line sub-segment distal from the point of rotation, wherein the changing the first characteristic of the line-sub segment distal from the point of rotation comprises:

determining at least one of: a speed, a velocity, a color intensity, a tint, a shade, a saturation, a lightness, a brightness, or a gray level of the line sub-segment from a part of data representing the line sub-segment moving on the display;

calculating a transitional characteristic for the line sub-segment with respect to the at least one of: the speed, the velocity, the color intensity, the tint, the shade, the saturation, the lightness, the brightness, or the gray level of the line sub-segment; and changing the first characteristic of the line sub-segment to the transitional characteristic, and wherein if the line segment moving in the direction is moving substantially aligned with the orientation, then the processor performs a second action.

13. The method of claim 12, further comprises:

if the processor determines that the orientation is substantially perpendicular to the direction in which the line segment is moving, the first action comprises:

changing a second characteristic of at least part of the line segment; and rendering the line segment to the display after the changing the second characteristic.

14. The method of claim 12, wherein if the line segment moving the direction is rotating relative to the orientation around a point of rotation, the method further comprises:

rendering the line segment to the display after the changing the first characteristic.

15. An electronic device comprising:

a vertical alignment liquid crystal display; and a processor that executes processor readable instructions stored on a processor readable storage medium, the processor being at least indirectly in communication with the liquid crystal display in accordance with which:

the processor causes the liquid crystal display to render a line segment having an orientation and moving on the liquid crystal display, the processor determines whether the line segment moving on the liquid crystal display is rotating relative to the orientation of the line segment around a point of rotation wherein a line sub-segment of the line segment distal from the point of rotation moves at a greater speed than a second line sub-segment of the line segment proximate to the point of rotation, the processor performs a first action, if the processor determines that line segment is rotating relative to the orientation of the line segment around the point of rotation, wherein the first action comprises of changing a first characteristic of the line sub-segment distal from the point of rotation, wherein the changing the first characteristic of the line-sub segment distal from the point of rotation comprises:

determining at least one of: a speed, a velocity, a color intensity, a tint, a shade, a saturation, a lightness, a brightness, or a gray level of the line sub-segment from a part of data representing the line sub-segment moving on the display;

calculating a transitional characteristic for the line sub-segment with respect to the at least one of: the speed, the velocity, the color intensity, the tint, the shade, the saturation, the lightness, the brightness, or the gray level of the line sub-segment; and changing the first characteristic of the line sub-segment to the transitional characteristic, and the processor performs a second action, if the processor determines that the line segment is moving substantially aligned with the orientation of the line segment.

16. The electronic device of claim 15, wherein the first action comprises changing color intensity of the line segment while the line segment is in motion.

17. The electronic device of claim 16, wherein the processor changes the color intensity of the line segment with respect to at least one of a speed, a velocity, or a gray level of the line segment.

* * * * *